US007882867B2

(12) United States Patent
Yang

(10) Patent No.: US 7,882,867 B2
(45) Date of Patent: Feb. 8, 2011

(54) MORTISE/TENON MACHINE

(76) Inventor: Jack Yang, No. 176, Yuanhuan S. Rd., Fongyuan City, Taichung County (TW)

( * ) Notice: Subject to any disclaimer, the term of this patent is extended or adjusted under 35 U.S.C. 154(b) by 159 days.

(21) Appl. No.: 12/333,375

(22) Filed: Dec. 12, 2008

(65) Prior Publication Data

US 2010/0147421 A1 Jun. 17, 2010

(51) Int. Cl.
*B27C 5/00* (2006.01)

(52) U.S. Cl. ..... 144/144.51; 144/198.1

(58) Field of Classification Search ..... 144/69–71, 144/74, 75, 82–87, 144.51, 198.1
See application file for complete search history.

(56) References Cited

U.S. PATENT DOCUMENTS 478,544 A * 7/1892 Cordesmman et al. ..... 144/87
610,272 A * 9/1898 Lindwall ..... 144/87
2,586,798 A * 2/1952 Eck ..... 144/87
2,607,375 A * 8/1952 Gillespie et al. ..... 144/87
2,747,627 A * 5/1956 Havlik ..... 144/85
3,272,244 A * 9/1966 Nemec ..... 144/87
4,875,510 A * 10/1989 Muellers ..... 144/145.2
5,305,812 A * 4/1994 Ferencsik ..... 144/356
6,929,042 B2 * 8/2005 Chang ..... 144/71
6,991,007 B2 * 1/2006 Chang ..... 144/71
2008/0257452 A1 * 10/2008 Yang ..... 144/205

* cited by examiner

*Primary Examiner*—Shelley Self
(74) *Attorney, Agent, or Firm*—Alan Kamrath; Kamrath & Associates PA

(57) ABSTRACT

A mortise/tenon machine has a base which includes two side plates, a guiding plate installed between the side plates transversely and horizontally, numbers of openings formed on a side of the guiding plate, and a rail member installed between the side plates and in the same horizontal position of the guiding plate. A workpiece is slideably disposed on the openings. A sliding base is slideably mounted on the rail member. A working platform includes a bit installed at a first end thereof, with the bit extending from a desired opening, and with another end of the working platform longitudinally disposed on the sliding base.

20 Claims, 6 Drawing Sheets

MORTISE/TENON MACHINE

BACKGROUND OF THE INVENTION

1. Field of the Invention

The present invention relates to a mortise/tenon machine.

2. Description of the Related Art

Referring to FIG. 6, a base (not shown) of a conventional mortise/tenon machine includes a working platform 1 affixed thereon, a guiding plate 2 attached to the working platform 1, a plurality of openings 3 formed on an edge of the guiding plate 2 and equally spaced from one another, a router 4 disposed on a side of the guiding plate 2 and a bit (not shown) installed on the bottom of the router 4. A workpiece (not shown) can be disposed onto the guiding plate 2 above the openings 3. The router 4 slides transversely along the openings 3 and drives the bit to cut mortises and tenons on the workpiece. After finishing cutting, users have to lift a grip 5 on the router 4 to put the router 4 back to its original position. It is low efficiency and wastes time for work.

The present invention will become clearer in light of the following detailed description of an illustrative embodiment of this invention described in connection with the drawings.

SUMMARY OF THE INVENTION

Aspects of the present invention address one or more of the issues mentioned above, thereby providing a mortise/tenon machine. The mortise/tenon machine includes a base, a working platform and a driven member. The driven member is adapted to drive the working platform to slide transversely/longitudinally with respect to the base. An operable handle device of the driven member is adapted to simultaneously drive the working platform and the driven member.

A support plate is installed on the base for supporting a workpiece and includes a longitudinal scale, and a user can read a distance value of vertical movement of a bit installed on the working platform with respect to a guiding plate of the base.

Two regulating members, which are respectively provided at two sides of the base and installed to two ends of the guiding plate, are adapted for adjusting horizontal positions of the two ends of the guiding plate.

A feed arrangement member connects the working platform to the driven member and is adapted to measure a distance value of horizontal movement of the bit with respect to the guiding plate.

These and other aspects are addressed in relation to the Figures and related description.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
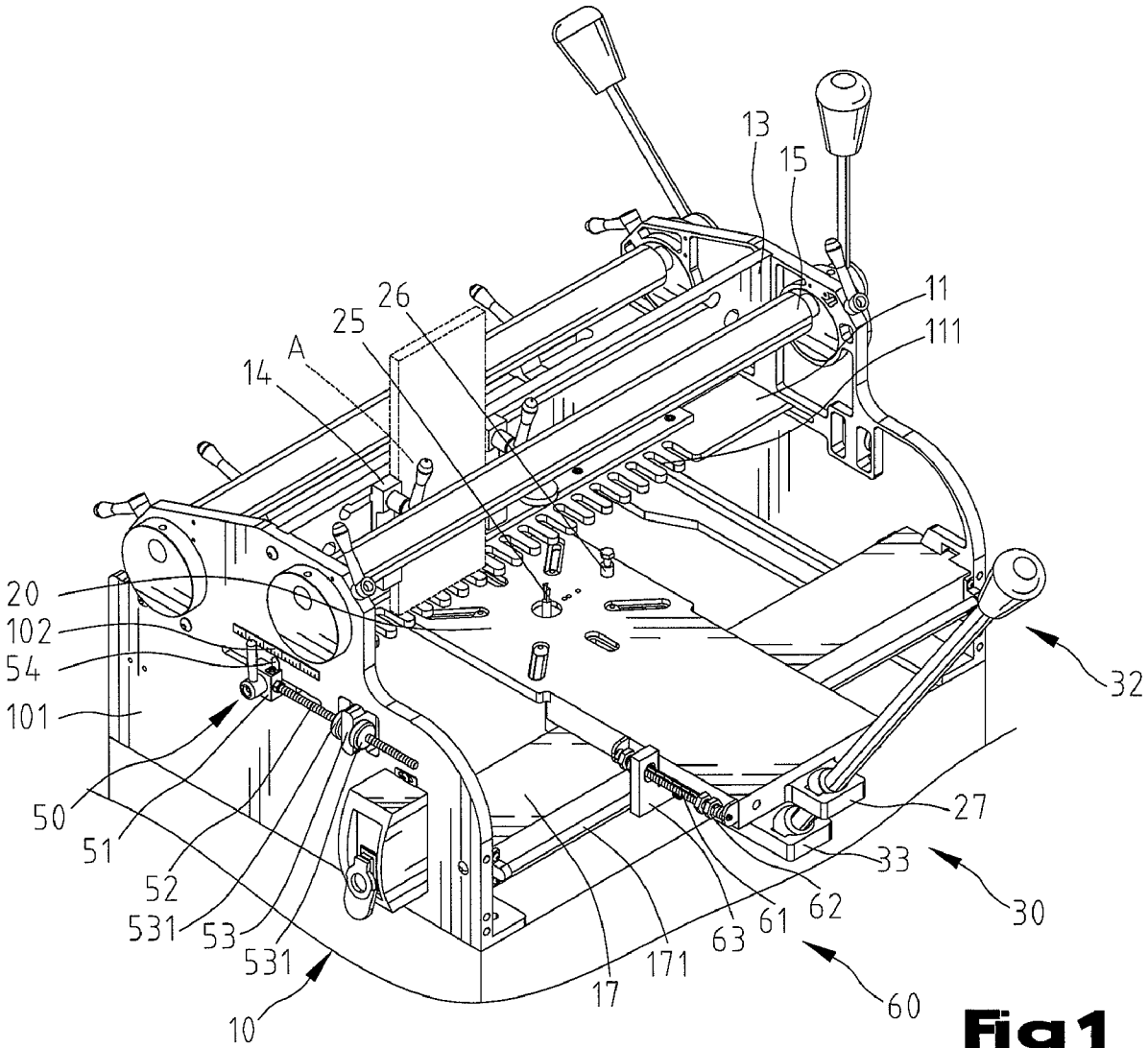
FIG. 1 is a perspective view of a mortise/tenon machine according to the preferred embodiment of the present invention.
Figure 2:
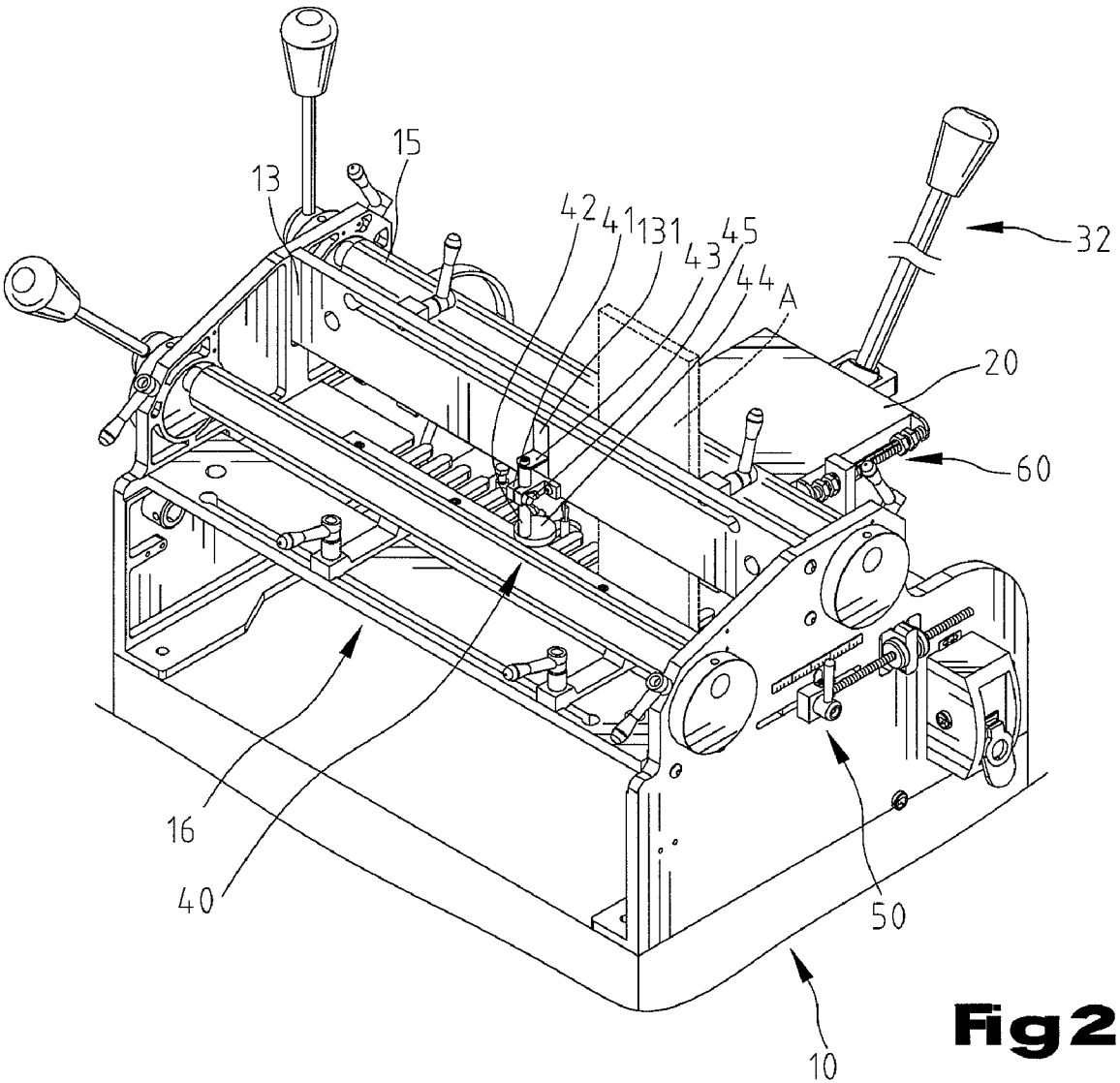
FIG. 2 is another perspective view of the mortise/tenon machine shown in FIG. 1.
Figure 3:
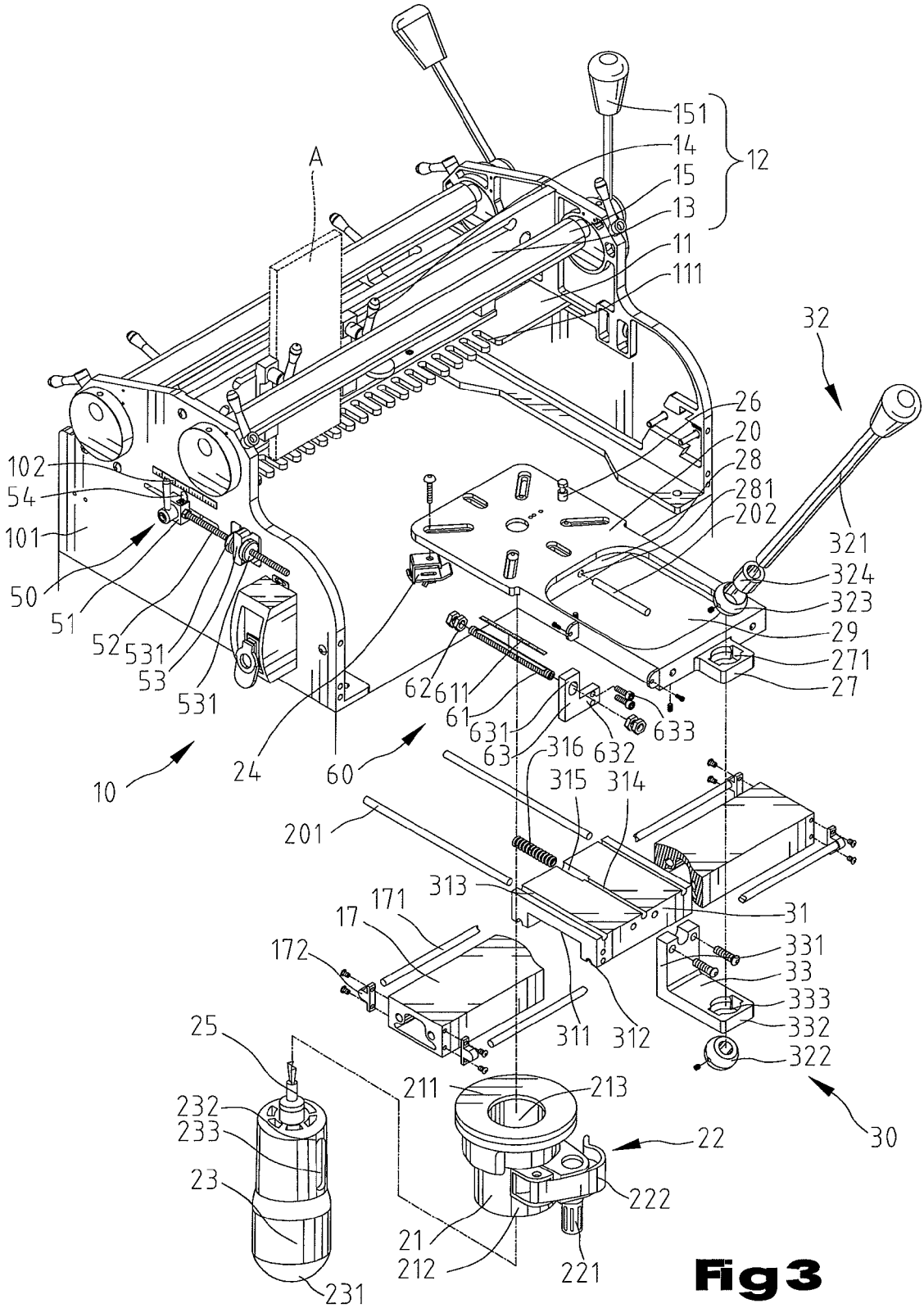
FIG. 3 is an exploded perspective view of the mortise/tenon machine shown in FIG. 1.

Referring to FIGS. 1 through 3, a mortise/tenon machine includes a base 10, a working platform 20, a driven member 30, a measuring member 40, two regulating members 50 and a feed arrangement member 60.

Two side plates 101 are provided on two sides of the top of the base 10, and a guiding plate 11 is slideably installed between the side plates 101 horizontally. A plurality of openings 111 are formed at a side of the guiding plate 11 and spaced equally from one another. An workpiece A (dotted line) shown in FIG. 3 is disposed on the openings 111 vertically and is desired to be cut for forming a plurality of mortises and tenons (not numbered) at an edge thereof. A distance of space between each opening 111 is designed to correspond to that of the mortises and tenons of the workpiece A. A first clamping device 12 is installed at the base 10. The first clamping device 12 includes a support plate 13 affixed between the side plates 101 vertically and adapted to abut against a side of the workpiece A. The first clamping device 12 further includes two clamping portions 14 slideably disposed along the support plate 13 and adapted to clamp the workpiece A for fixing the workpiece A at the first clamping device 12. A clamping spindle 15 is installed through the side plates 101, and the workpiece A is between the support plate 13 and the clamping spindle 15. A handle 151 is provided at one side plate 101 and is coupled to an end of the clamping spindle 15. The handle 151 allows a rotation bias of the clamping spindle 15 to the workpiece A. A second clamping device 16 is installed at the base 10 opposite to the first clamping device 12 with respect to the support plate 13. The first clamping device 12 is adapted for clamping the workpiece A as the workpiece A is disposed at the guiding plate 11 vertically, and the second clamping device 16 is adapted for clamping the workpiece A as the workpiece A is disposed at the guiding plate 11 horizontally. However, the structure of the second clamping device 16 is similar to the first clamping device 12 in substance. Therefore, the second clamping device 16 is not described in detail herein. A rail member 17 is installed between the side plates 101. The rail member 17 and the guiding plate 11 are approximately in the same horizontal position at the base 10. The rail member 17 is in a form of a hollow rectangular block and includes two first rods 171 installed to two sides thereof via a plurality of fixed elements 172. In this embodiment, the predetermined amount of the fixed elements 172 is four.

The driven member 30 includes a sliding base 31 slideably mounted on the rail member 17, an operable handle device 32 and a connecting element 33. The working platform 20 is slideably installed onto the sliding base 31 so that the working platform 20 is driven by the sliding base 31 to slide longitudinally with respect to the base 10. Further, the sliding base 31 is able to slide along the rail member 17 as to drive the working platform 20 to slide transversely with respect to the base 10 between the side plates 101. The operable handle device 32 connects the working platform 20 to the driven member 30 and is adapted for driving the working platform 20 to slide transversely/longitudinally with respect of the base 10 via the sliding base 31.

A slide rail 311 is transversely formed on the bottom of the sliding base 31, so that a cross section of the sliding base 31 is preferably inverted U-shaped. Two first slide channels 312, which are formed on the bottom of the sliding base 31, are respectively directed along two sides of the slide rail 311 and mounted along the first rods 171. The first slide channels 312 are parallel to each other. While the slide rail 311 slides along the rail member 17, the first rods 171 are respectively slideably received in the first slide channels 312. Two second slide channels 313, which are formed on the top surface of the sliding base 31, are respectively adjacent to the periphery of the sliding base 31. The second slide channels 313 are parallel to each other and perpendicular to the first slide channels 312. A third slide channel 314 is formed on the top surface of the sliding base 31 between the second slide channels 313. The second and third slide channels 313 and 314 are parallel to one another. An end of the third slide channel 314 adjacent to the guiding plate 11 defines a receiving portion 315, and a diameter of a cross section of the third slide channel 314 is smaller than that of the receiving portion 315. An elastic element 316 is disposed in the receiving portion 315 and abuts against the slide channel 314. The connecting element 33 is installed to a side of the sliding base 31 and adjacent to another end of the third slide channel 314 opposite to the receiving portion 315. The connecting element 33 is preferably L-shaped and includes a first connecting portion 331 abutted with and fixed to the side of the sliding base 31 via a plurality of bolts (not numbered) and a second connecting portion 332 parallel to the top surface of the sliding base 31. The first and second connecting portions 331 and 332 are perpendicular to each other approximately. A first connecting hole 333 is formed on the second connecting portion 332 for connecting the operable handle device 32 to the second connecting portion 332.

The operable handle device 32 further includes a main handle 321, a first sphere element 322 received in the first connecting hole 333, a second sphere element 323 disposed at the working platform 20 and related to the first sphere element 322 and a sleeve 324 received in the second sphere element 323. An end of the main handle 321 is inserted through the sleeve 324 and the second sphere element 323 into the first sphere element 322. Another end of the main handle 321 is adapted for holding by a user.

The working platform 20 is disposed below the guiding plate 11 and has a first end adjacent to the guiding plate 11 and a second end. A base member 21 is installed to the bottom of the first end of the working platform 20 via four fastening elements 24 and has a first end 211 and a second end 212. While the base member 21 is installed to the working platform 20, the periphery of the first end 211 of the base member 21 is coupled to the base member 21 to fix the base member 21 to the working platform 20. A through-hole 213 penetrates the base member 21 longitudinally from the first end 211 to the second end 212. A clipping member 22 is provided on the periphery of the base member 21 between the first and second ends 211 and 212. A router 23 includes a first end 231 and a second end 232 and is inserted into the through-hole 213, with the first end 231 exposed from the base member 21, and with the second end 232 received in the through-hole 213. An adjusted portion 233 is defined on the periphery of the router 23 between the first and second ends 231 and 232 and corresponds to the clipping member 22. The clipping member 22 further has an adjusting portion 221 and a fixed portion 222. The adjusting portion 221 is adapted to engage with the adjusted portion 233 for adjusting a longitudinal position of the router 23, and the fixed portion 222 is adapted to fix the router 23 in position. A bit 25 is installed onto the top of the second end 232 and is inserted through the working platform 20 to be exposed from the guiding plate 11 and to extend from one of the plurality of openings 111. Thus, the clipping member 22 is adapted for adjusting the longitudinal positions of the bit 25 with respect to the working platform 20 and the guiding plate 11.

A guiding element 26 is set on the top surface of the first end of the working platform 20 and adjacent to the right side of the working platform 20. A distance of the bit 25 and the guiding element 26 corresponds to a distance between several of the openings 111 so that in use, the guiding element 26 is driven into one of the openings 111, and, simultaneously the bit 25 can be guided into the desired opening 111.

A connecting portion 27 is provided on a side of the second end of the working platform 20 opposite to the first end of the working platform 20 and corresponds to the second connecting portion 332. A second connecting hole 271 is formed on the connecting portion 27 and corresponds to the first connecting hole 331. In this embodiment, the first and second connecting holes 333 and 271 are not circular and, respectively, have two recesses (not numbered) communicating with the related connecting hole. The second sphere member 323 is received in the second connecting hole 271. While the operable handle device 32 is operated, the first and second sphere members 322 and 323 are able to rotate in the first and second connecting holes 333 and 271, respectively, as to drive the working platform 20 to slide transversely/longitudinally with respect to the base 10.

A blocked portion 28 extends from the bottom of the working platform 20 between the first and second ends of the working platform 20. A receptacle 29 is defined on the bottom of the second end of the working platform 20 adjacent to the blocked portion 28 and is adapted to be mounted on the sliding base 31. An orifice 281 is formed in the blocked portion 28 and is open to the receptacle 29. Two second rods 201 and a third rod 202 are slideably provided to the bottom of the working platform 20, with an end of the third rod 202 inserted to the orifice 281. The second rods 201 are further respectively inserted into the second slide channels 313, so that the working platform 20 can slide along the sliding base 30 longitudinally with respect to the base 10. Another end of the third rod 202 is inserted through the elastic element 316 to the receiving portion 315 and the third slide channel 314, and two ends of the elastic element 316 respectively abut with the blocked portion 28 and the third slide channel 314.

The measuring member 40 is installed to the support plate 13 opposite the clamping spindle 15 and includes a fixed portion 41 locked at the support plate 13. An adjusted rod 42 is inserted through the fixed portion 41 and has a first end and a second end. A first measuring portion 43 is provided on the first end of the adjusted rod 42 and indicates to a longitudinal scale 131 on the support plate 13. A second measuring portion 44 is coupled to the second end of the adjusted rod 42. An operating portion 45 is provided at the fixed portion 41 and is adapted for adjusting the longitudinal position of the adjusted rod 42 with respect to the fixed portion 41. In use, the horizontal position of the second measuring portion 44 can be adjusted to correspond to that of the top of the bit 25 by operating the operating portion 45. Then, the first measuring portion 43 is driven to move longitudinally and indicates to a position of the longitudinal scale 131. Therefore, a user can read a vertical distance between the top of the bit 25 and the guiding plate 11 from the longitudinal scale 131.

The regulating members 50 are respectively installed to the outer surface of the side plates 101. Each regulating member 50 includes a sliding block 51 connected to the guiding plate 11 and slideably extends out of the related side plate 101, with the sliding block 51 able to move with the guiding plate 11 related to the base 10. A coupling portion 53 is fixed onto the related side plate 101. An end of a screwing rod 52 is inserted through the coupling portion 53, and another end of the screwing rod 52 is affixed to the sliding block 51. An indicator 54 is formed on the sliding block 51 for indicating to a transverse scale 102 on the related side plate 101. The user can adjust two adjusting elements 531, which are respectively provided on two ends of the coupling portion 53, to drive the sliding block 51 to slide horizontally and slightly regulate the horizontal position of the guiding plate 11.

The feed arrangement member 60 is installed on a side of the working platform 20 adjacent to one of the side plates 101 and includes a guide rod 61 parallel to the third rod 202, two adjusting nut units 62 and a coupled element 63. The adjusting nut units 62 are respectively adapted to engage two ends of the guide rod 61 with the working platform 20. The coupled element 63, which is preferably L-shaped and has a first section 631 and a second section 632, is provided to be slideable along the guide rod 61 between the adjusting nut units 62. The first and second sections 631 and 632 are perpendicular to each other. The first section 631 is inserted by the guide rod 61, and the second section 632 is affixed to the sliding base 31 via two bolts 633. Thus, the coupled element 63 is driven by the sliding base 31. A feed scale 611 is disposed above the guide rod 61 so that while the coupled element 63 is driven to slide along the guide rod 61, the user can read a value of a distance of horizontal movement of the working platform 20 with respect to the sliding base 31 as to further adjust a horizontal position of the bit 25 with respect to the guiding plate 11.

In use, the workpiece A is attached to the base 10 first. Then, the second measuring portion 44 is adjusted to align a desired vertical position of mortise/tenon on the workpiece A via the operating portion 45, and users can read a value from the longitudinal scale 131 where the first measuring portion 43 indicates. Further, a vertical position of the router 23 is adjusted via the adjusting portion 221 of the clipping member 22. Then, the router 23 is fixed in position via operating the fixed portion 222 of the clipping member 22. Therefore, the bit 25 can be exposed from the guiding plate 11 to a position for cutting the desired mortise/tenon on the workpiece A.

The sliding base 31 smoothly transversely slides along the first rods 171 via the second slide channels 313, and the working platform 20 smoothly longitudinally slides along the second and third rods 201 and 202 via the second and third slide channels 313 and 314, respectively. No bearing is needed to assist sliding of the sliding base 31 and the working platform 20 as to save cost.

In addition, each sliding block 51 is adjustable to drive the guiding plate 11 to move forwardly/backwardly with respect to the workpiece A via operating the adjusting elements 531. In operation, users can operate the adjusting elements 531 of one sliding block 51 to adjust a horizontal position of the related side of the guiding plate 11 and can read a value from the related transverse scale 102 indicated by the related indicator 54. Further, users can adjust a horizontal position of another side of the guiding plate 11 in accordance with the said value. Therefore, the horizontal positions of the two sides of the guiding plate 11 can be even.

Figure 4:
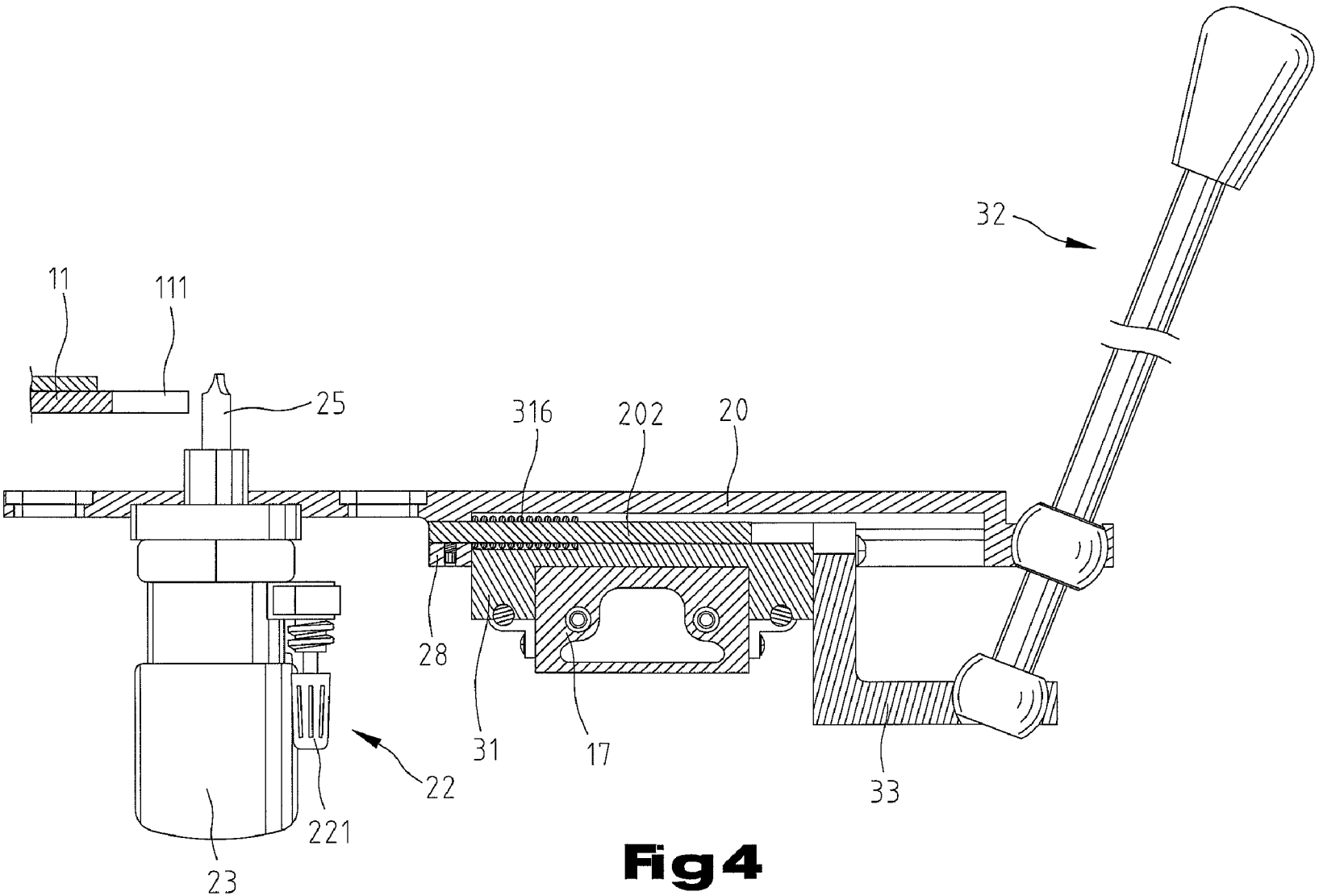
FIG. 4 is a cross-sectional view of the mortise/tenon machine shown in FIG. 1.
Figure 5:
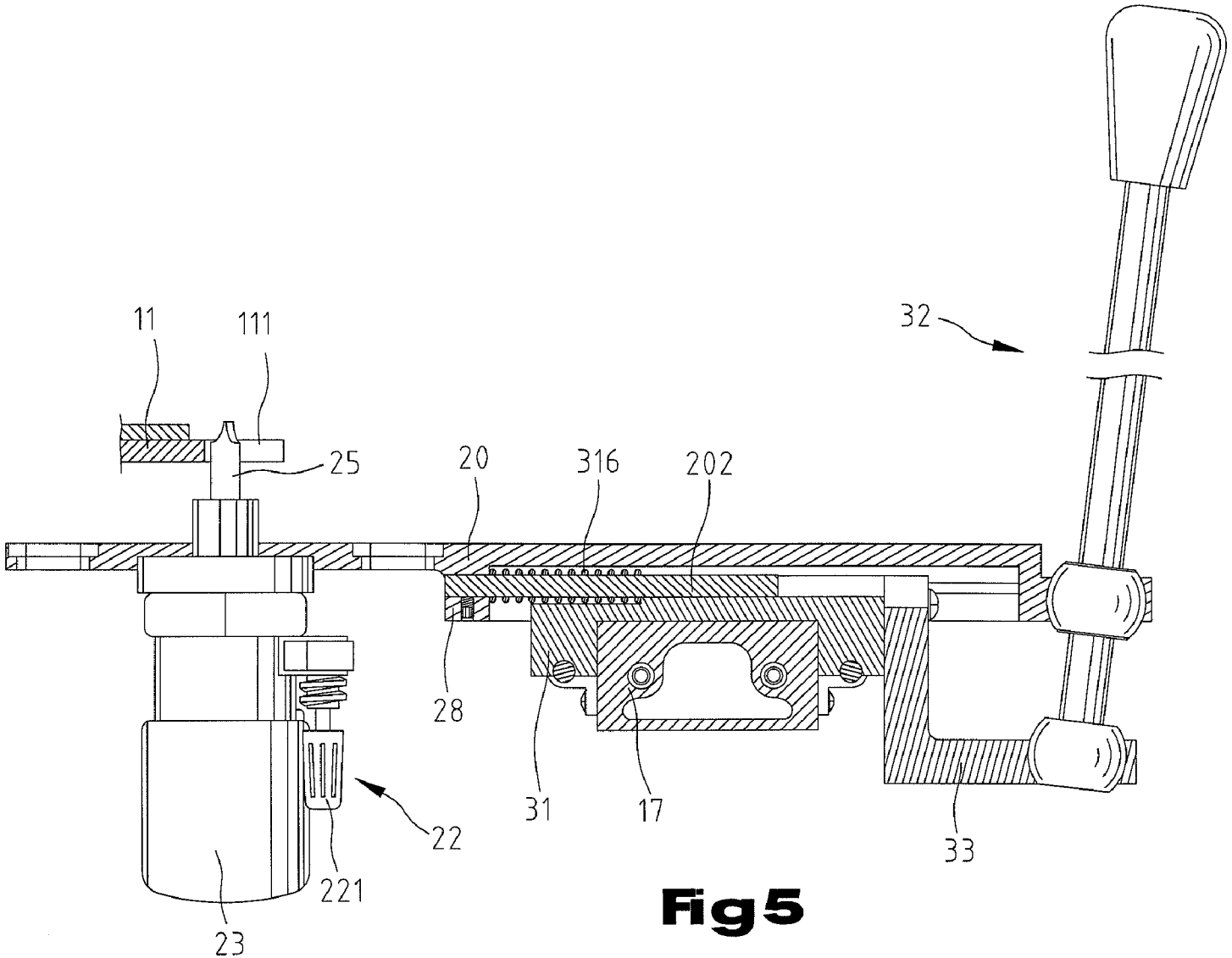
FIG. 5 is another cross-sectional view similar to FIG. 4.
Figure 6:
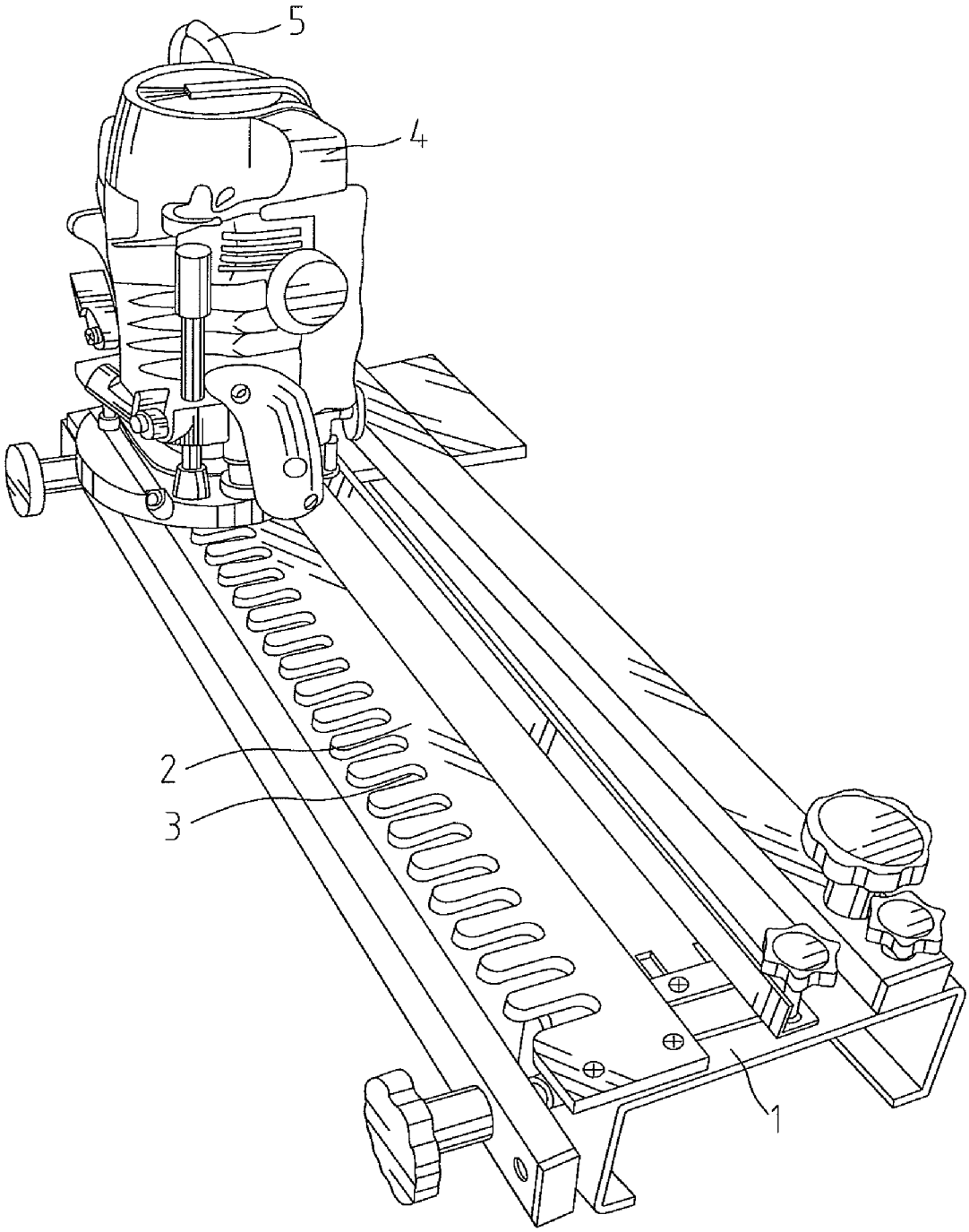
Fig6 PRIOR ART
FIG. 6 is a perspective view of a conventional mortise/tenon machine.

Referring to FIGS. 1, 4 and 5, users can operate the operable handle device 32 to drive the working platform 20 to slide transversely/longitudinally with respect to the base 10. The guiding element 26 is able to be driven into a desired opening 111 and further drive the bit 25 to move into the related opening 111 for cutting the workpiece A. While the bit 25 is going to move backward from the related opening 111, the operable handle device 32 is operated to drive the working platform 20 away from the guiding plate 11. Simultaneously, the elastic element 316 is pressed by the blocked portion 28 towards the third slide channel 314, then, the guiding element 26 is driven to move transversely with respect to the guiding plate 11, and the bit 25 is driven to align with a position of another desired opening 111 by operating the operable handle device 32. Finally, users release the operable handle device 32, so that the elastic element 316 is released to press toward the blocked portion 28 and pushes the working platform 20 for moving the bit 25 into the related opening 111. A distance of horizontal movement of the working platform 20 with respect to the sliding base 31 can be read from the feed scale 611 on the guide rod 61, because the coupled element 63 is connected the working platform 20 with the sliding base 31.

Deliberative but not limiting descriptions of the embodiment of the present invention have been made. However, it should be understood that the technical staffs in this field may make changes and/or modifications without being away from the related scope of protection as defined in the claims.

What is claimed is:

1. A mortise/tenon machine comprising:

a base including side plates and a guiding plate installed between the side plates transversely and horizontally, with a plurality of openings formed on the guiding plate, with a workpiece disposed slideably on the openings;

a rail member installed between the side plates, with the rail member and the guiding plate being approximately in a same horizontal position at the base;

a sliding base mounted on the rail member transversely and slideably, wherein the sliding base further includes a slide rail transversely formed on a bottom of the sliding base for sliding along the rail member;

a working platform having a first end and a second end, with the second end of the working platform disposed on the sliding base longitudinally and slideably; and an operable handle device connecting the second end of the working platform and a side of the sliding base that is opposite to the guiding plate;

wherein the operable handle device drives the sliding base to transversely slide with respect to the base and simultaneously drives the working platform to longitudinally slide with respect to the base.

2. The mortise/tenon machine as claimed in claim 1, further comprising a bit provided on the first end of the working platform and extending from one of the plurality of openings of the base; and a guiding element set on the top surface of the first end of the working platform, and with a distance of the bit and the guiding element corresponding to a distance between several of the openings.

3. The mortise/tenon machine as claimed in claim 2, further comprising a support plate affixed between the side plates vertically and adapted to abut against a side of the workpiece, and a measuring member installed to the support plate and adapted to measure a vertical distance between the top of the bit and the guiding plate from a longitudinal scale provided on the support plate.

4. The mortise/tenon machine as claimed in claim 1, further comprising a feed arrangement member installed on a side of the working platform adjacent to one of the side plates of the base and including a guide rod and a coupled element, with the coupled element slideably disposed along the guide rod and connecting the sliding base with the working platform, and with a feed scale disposed above the guide rod, wherein a user can read a distance value of horizontal movement of the working platform with respect to the sliding base.

5. The mortise/tenon machine as claimed in claim 1, further comprising two regulating members respectively installed to the outer surface of the side plates and connected to two ends of the guiding plate; wherein each regulating member slightly regulates the horizontal positions of the two ends of the guiding plate.

6. The mortise/tenon machine as claimed in claim 1, further comprising two first rods installed to two sides of the rail member; two first slide channels transversely formed on the bottom of the sliding base and mounted along the two first rods; two second slide channels longitudinally formed on the top surface of the sliding base; and two second rods respectively inserted into the second slide channels, with the two first slide channels respectively provided on two sides of the slide rail, with the two second slide channels parallel to each other and perpendicular to the two first slide channels.

7. The mortise/tenon machine as claimed in claim 6, further comprising a third slide channel formed on the top surface of the sliding base between the second slide channels and a third rod slideably provided to the bottom of the working platform; wherein the working platform further includes a blocked portion extending from the bottom thereof between the first and second ends thereof, with an end of the third rod inserted to the blocked portion, with another end of the third rod inserted into the third slide channel.

8. The mortise/tenon machine as claimed in claim 7, further comprising a receiving portion defined at an end of the third slide channel adjacent to the guiding plate and an elastic element disposed in the receiving portion and abutted against the slide channel, with the third rod inserted through the elastic element to the receiving portion and the third slide channel, with two ends of the elastic element respectively abutted with the blocked portion and the third slide channel, and with a diameter of a cross section of the third slide channel smaller than that of the receiving portion.

9. The mortise/tenon machine as claimed in claim 3, further comprising a first clamping device installed at the base; wherein the first clamping device includes the support plate, two clamping portions slideably disposed along the support plate and adapted to clamp the workpiece and a clamping spindle installed through the side plates, with the workpiece provided between the support plate and the clamping spindle.

10. The mortise/tenon machine as claimed in claim 5, wherein each regulating member includes a sliding block connected to the guiding plate and slideably disposed out of the related side plate, with the sliding block able to move with the guiding plate related to the base, a coupling portion fixed onto the related side plate, a screwing rod, with an end of the screwing rod inserted through the coupling portion and another end of the screwing rod affixed to the sliding block, an indicator formed on the sliding block and indicating to a transverse scale on the related side plate.

11. The mortise/tenon machine as claimed in claim 1, further comprising a connecting portion provided on a side of the second end of the working platform opposite to the first end of the working platform and a L-shaped connecting element affixed to a side of the sliding base opposite to the guiding plate, with a first connecting hole formed on the second connecting portion, with a second connecting hole formed on the connecting portion and corresponding to the first connecting hole.

12. The mortise/tenon machine as claimed in claim 11, wherein the operable handle device further includes a main handle, a first sphere element received in the first connecting hole, a second sphere element received in the second connecting hole and a sleeve received in the second sphere element; wherein an end of the main handle is inserted through the sleeve and the second sphere element into the first sphere element, and with another end of the main handle adapted for holding by a user.

13. The mortise/tenon machine as claimed in claim 8, further comprising a connecting portion provided on a side of the second end of the working platform opposite to the first end of the working platform and a L-shaped connecting element affixed to a side of the sliding base and adjacent to another end of the third slide channel opposite to the receiving portion, with a first connecting hole formed on the second connecting portion, with a second connecting hole formed on the connecting portion and corresponding to the first connecting hole.

14. The mortise/tenon machine as claimed in claim 13, wherein the operable handle device further includes a main handle, a first sphere element received in the first connecting hole, a second sphere element received in the second connecting hole and a sleeve received in the second sphere element; wherein an end of the main handle is inserted through the sleeve and the second sphere element into the first sphere element, and with another end of the main handle adapted for holding by a user.

15. The mortise/tenon machine as claimed in claim 2, further comprising a base member installed to a bottom of the first end of the working platform via a plurality of fastening elements, with a through-hole penetrating the base member longitudinally, with a clipping member provided on the periphery of the base member;

wherein a router is partially inserted into the through-hole and includes an adjusted portion defined on a periphery of the router and corresponding to the clipping member, wherein the bit is installed on a top of the router, and wherein the clipping member is adapted for adjusting and fixing a longitudinal position of the bit with respect to the guiding plate.

16. The mortise/tenon machine as claimed in claim 15, wherein the clipping member further includes an adjusting portion and a fixed portion, with the adjusting portion adapted to engage with the adjusted portion for adjusting the longitudinal position of the router with the bit, and the fixed portion adapted to fix the router with the bit in position.

17. A mortise/tenon machine comprising:

a base including side plates and a guiding plate installed between the side plates transversely and horizontally, with a plurality of openings formed on the guiding plate, with a workpiece disposed slideably on the openings;

a rail member installed between the side plates, with the rail member and the guiding plate being approximately in a same horizontal position at the base;

a support plate affixed between the side plates vertically and adapted to abut against a side of the workpiece;

a sliding base mounted on the rail member transversely and slideably;

a working platform having a first end and a second end, with the second end of the working platform disposed on the sliding base longitudinally and slideably; and a bit provided on the first end of the working platform and extending from one of the plurality of openings of the base;

a measuring member installed to the support plate and adapted to measure a vertical distance between a top of the bit and the guiding plate from a longitudinal scale provided on the support plate; and an operable handle device connecting the second end of the working platform and a side of the sliding base that is opposite to the guiding plate;

wherein the operable handle device drives the sliding base to transversely slide with respect to the base and simultaneously drives the working platform to longitudinally slide with respect to the base, wherein the measuring member further includes a fixed portion locked at the support plate, an adjusted rod inserted through the fixed portion and having a first end and a second end, a first measuring portion provided on the first end of the adjusted rod and indicating to the longitudinal scale, a second measuring portion coupled to the second end of the adjusted rod and an operating portion provided at the fixed portion and adapted for adjusting a longitudinal position of the adjusted rod with respect to the fixed portion.

18. A mortise/tenon machine comprising:

a base including side plates and a guiding plate installed between the side plates transversely and horizontally, with a plurality of openings formed on the guiding plate, with a workpiece disposed slideably on the openings;

a rail member installed between the side plates, with the rail member and the guiding plate being approximately in a same horizontal position at the base;

a support plate affixed between the side plates vertically and adapted to abut against a side of the workpiece;

a sliding base mounted on the rail member transversely and slideably;

a working platform having a first end and a second end, with the second end of the working platform disposed on the sliding base longitudinally and slideably; and a bit provided on the first end of the working platform and extending from one of the plurality of openings of the base;

a measuring member installed to the support plate and adapted to measure a vertical distance between a top of the bit and the guiding plate from a longitudinal scale provided on the support plate; and an operable handle device connecting the second end of the working platform and a side of the sliding base that is opposite to the guiding plate;

wherein the operable handle device drives the sliding base to transversely slide with respect to the base and simultaneously drives the working platform to longitudinally slide with respect to the base, wherein the measuring member further includes a fixed portion locked at the support plate, an adjusted rod inserted through the fixed portion and having a first end and a second end, a first measuring portion provided on the first end of the adjusted rod and indicating to the longitudinal scale, a second measuring portion coupled to the second end of the adjusted rod and an operating portion provided at the fixed portion and adapted for adjusting a longitudinal position of the adjusted rod with respect to the fixed portion; and a first clamping device installed at the base;

wherein the first clamping device includes the support plate, two clamping portions slideably disposed along the support plate and adapted to clamp the workpiece and a clamping spindle installed through the side plates, with the workpiece provided between the support plate and the clamping spindle.

19. The mortise/tenon machine as claimed in claim 18, further comprising a guiding element set on a top surface of the first end of the working platform, and with a distance of the bit and the guiding element corresponding to a distance between several of the openings.

20. The mortise/tenon machine as claimed in claim 17, further comprising a guiding element set on a top surface of the first end of the working platform, and with a distance of the bit and the guiding element corresponding to a distance between several of the openings.

* * * * *